US008870580B2

(12) United States Patent
Kojima et al.

(10) Patent No.: US 8,870,580 B2
(45) Date of Patent: Oct. 28, 2014

(54) CONNECTOR WITH CONNECTING MEMBERS HELD BY A BEAM SUPPORTED BY A SUPPORTING MEMBER

(71) Applicant: Japan Aviation Electronics Industry, Limited, Tokyo (JP)

(72) Inventors: Takeru Kojima, Tokyo (JP); Takeshi Takahashi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 50 days.

(21) Appl. No.: 13/803,860

(22) Filed: Mar. 14, 2013

(65) Prior Publication Data

US 2013/0316588 A1 Nov. 28, 2013

(30) Foreign Application Priority Data

May 25, 2012 (JP) ..... 2012-119166

(51) Int. Cl.

| | |
|---|---|
| ***H01R 12/00*** | (2006.01) |
| ***H01R 12/70*** | (2011.01) |
| ***H01R 13/40*** | (2006.01) |
| ***H01R 13/24*** | (2006.01) |

(52) U.S. Cl.

CPC ..... *H01R 13/40* (2013.01); *H01R 12/7076* (2013.01); *H01R 13/2414* (2013.01)

USPC ..... 439/66

(58) Field of Classification Search

CPC .. H01R 23/722; H01R 9/096; H01R 13/2435; H01R 13/2414

See application file for complete search history.

(56) References Cited

U.S. PATENT DOCUMENTS

| | | | | |
|---|---|---|---|---|
| 4,421,370 | A * | 12/1983 | Treakle et al. | 439/91 |
| 5,049,084 | A * | 9/1991 | Bakke | 439/66 |
| 5,259,770 | A * | 11/1993 | Bates et al. | 439/66 |
| 6,224,394 | B1 * | 5/2001 | Matsumoto | 439/66 |
| 7,329,130 | B2 * | 2/2008 | Saito et al. | 439/66 |
| 7,448,878 | B2 * | 11/2008 | Saito et al. | 439/66 |

FOREIGN PATENT DOCUMENTS

JP 2007-095632 4/2007

* cited by examiner

*Primary Examiner* — Chandrika Prasad
(74) *Attorney, Agent, or Firm* — Collard & Roe, P.C.

(57) ABSTRACT

A connector is adapted to be interposed between a first connection object and a second connection object for establishing electrical connection therebetween. The connector comprises a plurality of connecting members each having a plurality of elastically deformable conductive portions formed at a predetermined interval along a longitudinal direction thereof, a beam holding the connecting members, and a support portion supporting the beam. The connecting members, each having its longitudinal direction extending in a second direction perpendicular to a first direction in which the first and second connection objects and are caused to approach each other, are arranged in a third direction perpendicular to the first and second directions. The beam is disposed with its longitudinal direction extending in the third direction so as to perpendicularly cross the connecting members. The beam has engaging portions, engaging with the connecting members, at positions where the beam crosses the connecting members.

11 Claims, 16 Drawing Sheets

CONNECTOR WITH CONNECTING MEMBERS HELD BY A BEAM SUPPORTED BY A SUPPORTING MEMBER

This application is based upon and claims the benefit of priority from Japanese patent application No. 2012-119166, filed on May 25, 2012, the disclosure of which is incorporated herein in its entirety by reference.

TECHNICAL FIELD

This invention relates to a connector which is interposed between connection objects for establishing electrical connection therebetween.

BACKGROUND ART

As shown in FIGS. 15 and 16, there has conventionally been known a connecting device 110 which is interposed between a pair of connection objects 160 and 170 for establishing electrical connection therebetween (see, e.g. JP-A-2007-95632 (Patent Document 1)). The connecting device 110 comprises a plurality of connecting members 120 each having a longitudinal direction extending in a second direction Y perpendicular to a first direction X in which the connection objects 160 and 170 are caused to approach each other. The connecting members 120 are arranged in a third direction Z perpendicular to the first and second directions X and Y. The connecting device 110 further comprises a frame 140 holding the connecting members 120. Each connecting member 120 comprises an elastic member 121, a support member 122 disposed in the elastic member 121, a plurality of conductors 124 formed in a predetermined pattern on a surface of the elastic member 121, and an inter-pitch portion 121A integrally formed with the elastic member 121 for keeping constant the distance between the conductors 124 adjacent to each other in the third direction Z.

As shown in FIG. 15, in the connecting device 110 of Patent Document 1, protruding portions 122A, protruding from both ends of the elastic members 121, of the support members 122 engage with the frame 140 so that the connecting members 120 are held to the frame 140.

SUMMARY OF THE INVENTION

However, in the connecting device 110 of Patent Document 1, since the connecting members 120 are held only at their both ends in the longitudinal direction, when the connecting device 110 is sandwiched between the connection objects 160 and 170, the connecting members 120 tend to be subjected to unwanted deformation, such as distortion or bending, due to forces applied from the connection objects 160 and 170. For example, the connecting members 120 are arched due to such forces so that middle portions in the longitudinal direction of the connecting members 120 are displaced in the third direction Z. Accordingly, there is a possibility that the positions of the conductors 124 may be offset from the correct positions due to such unwanted deformation of the connecting members 120, resulting in a reduction in contact reliability of the connecting device 110.

In the connecting device 110 of Patent Document 1, in order to prevent a short between the conductors 124 adjacent to each other in the third direction Z due to the above-mentioned unwanted deformation of the connecting members 120, the inter-pitch portions 121A are provided for keeping constant the distance between the conductors 124 as described above. However, this causes a problem that pitch narrowing of the conductors 124 in the third direction Z is hindered.

Therefore, this invention is intended to solve the above-mentioned problems and it is an object of this invention to provide a connector that prevents position offset of conductive portions and that achieves pitch narrowing of the conductive portions.

According to an exemplary aspect of the present invention, there is provided a connector which is adapted to be interposed between a first connection object and a second connection object for establishing electrical connection therebetween, comprising: a plurality of connecting members each having a plurality of elastically deformable conductive portions formed at a predetermined interval along a longitudinal direction thereof; a beam holding the connecting members; and a support portion supporting the beam, wherein the connecting members, each having its longitudinal direction extending in a second direction perpendicular to a first direction in which the first and second connection objects are caused to approach each other, are arranged in a third direction perpendicular to the first and second directions, and wherein the beam is disposed with its longitudinal direction extending in the third direction so as to perpendicularly cross the connecting members, the beam having engaging portions, engaging with the connecting members, at positions where the beam crosses the connecting members.

Each of the connecting members may have a beam receiving portion having a shape in which a portion, crossing the beam, of the connecting member is recessed in the first direction from its second connection object side toward its first connection object side, and the beam may be inserted in the first direction into the beam receiving portions of the connecting members and received therein.

Each of the engaging portions of the beam may have a shape which is recessed in the first direction from the first connection object side of the beam toward the second connection object side thereof, each of the connecting members may have beam engaging portions, and the beam engaging portions of the connecting members may be inserted in the first direction into the engaging portions of the beam to engage therewith.

The connector may further comprise a pressing member attached to the support portion for preventing the connecting members from coming off, and the pressing member may be disposed with its longitudinal direction extending in the third direction so as to perpendicularly cross the connecting members and is arranged on a side opposite to the beam in the first direction with respect to the connecting members.

Each of the connecting members may have a pressing member receiving portion having a shape in which a portion, crossing the pressing member, of the connecting member is recessed in the first direction from its first connection object side toward its second connection object side, and the pressing member may be inserted in the first direction into the pressing member receiving portions of the connecting members and received therein.

Each of the connecting members may comprise an elastic member and a film attached to a surface of the elastic member, and the film may be formed with the conductive portions and insulating portions which are alternately arranged in the second direction.

Each of the connecting members may further comprise a carrier disposed through the inside of the elastic member along the second direction.

The elastic member may comprise a plurality of elastic members which are arranged on the carrier so as to be spaced apart from each other at a predetermined interval in the second direction, at least one of spaces formed between the elastic members adjacent to each other in the second direction may serve as a beam receiving portion having a shape which is recessed in the first direction from the second connection object side of the connecting member toward the first connection object side thereof, and the beam may be inserted in the first direction into the beam receiving portions of the connecting members and received therein.

The beam may comprise a plurality of beams arranged in the second direction, and each of the connecting members may lie over at least two of the beams arranged in the second direction.

The connecting members may be arranged in the second direction, and the connecting members arranged in the second direction may be adjacent to each other in the second direction.

The beam may be formed separately from the support portion and fixed to the support portion.

According to this invention, since the beam having the engaging portions that engage with the connecting members is disposed so as to perpendicularly cross the connecting members, it is possible to support each connecting member at a portion other than both ends of the connecting member, i.e. at a portion inside both ends in the longitudinal direction of the connecting member. Therefore, when the connector is sandwiched between the connection objects, it is possible to suppress unwanted deformation, such as distortion or bending, of the connecting members due to forces applied from the connection objects and thus to suppress offset in position of the conductive portions due to such unwanted deformation of the connecting members. Consequently, it is possible to improve contact reliability of the connector.

Further, according to this invention, it is possible to keep constant the distance between the conductive portions of the connecting members adjacent to each other in the third direction without providing an inter-pitch portion for keeping constant the distance between the conductive portions as in the prior art connecting device. Consequently, it is possible to achieve pitch narrowing of the conductive portions in the third direction.

MODE FOR CARRYING OUT THE INVENTION

Hereinbelow, embodiments of this invention will be described with reference to the drawings.

In the following description, a direction in which connection objects are caused to approach each other is defined as a first direction X, a direction perpendicular to the first direction X is defined as a second direction Y, and a direction perpendicular to the first and second directions X and Y is defined as a third direction Z.

<Embodiments>

Figure 1:
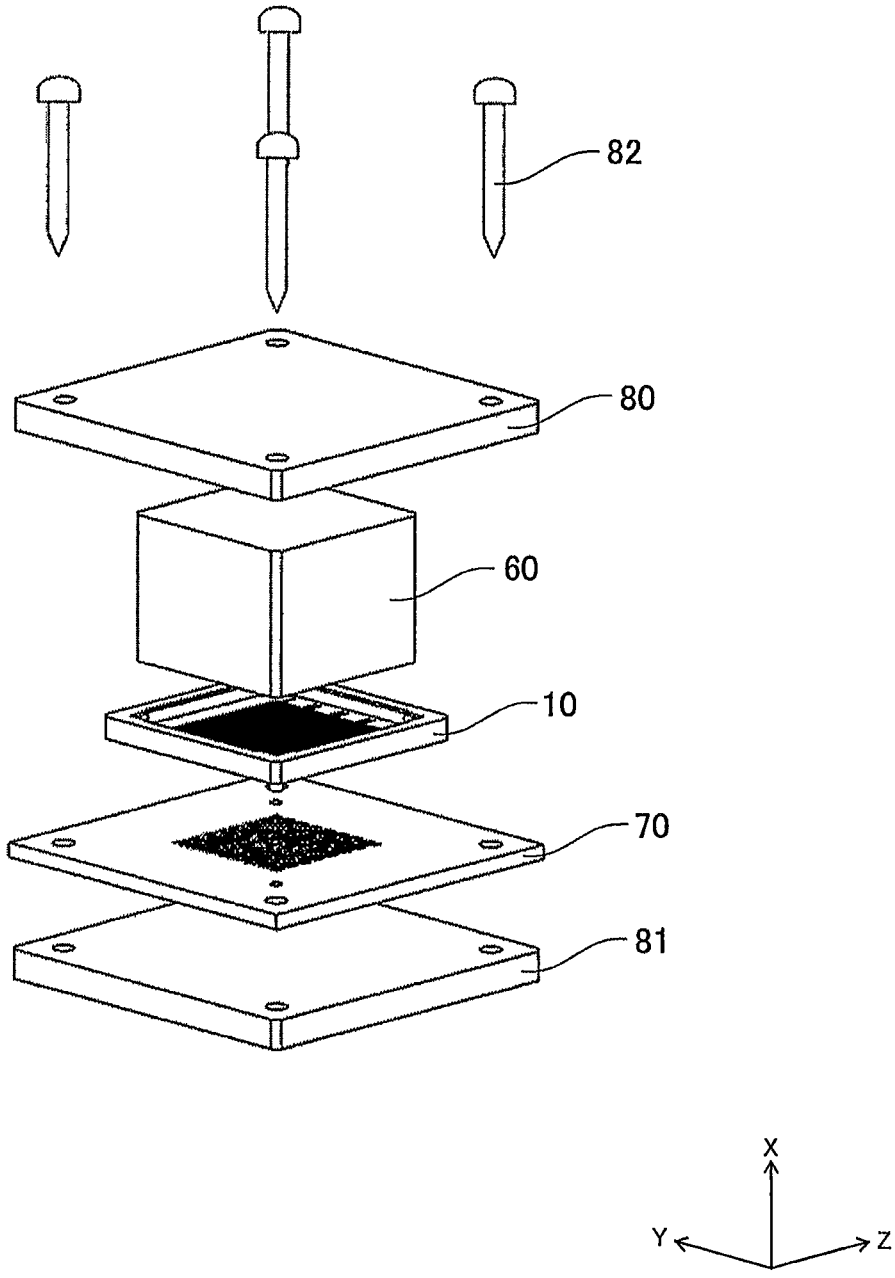
FIG. 1 is a perspective view showing the manner of using a connector according to a first embodiment of this invention.

As shown in FIG. 1, a connector 10 according to a first embodiment of this invention is adapted to be interposed between a first connection object 60 formed as an IC package and a second connection object 70 formed as a lower board, thereby establishing electrical connection between the first and second connection objects 60 and 70. In FIG. 1, numeral 80 denotes an upper stiffener, numeral 81 denotes a lower stiffener, and numeral 82 denotes screws for fixing the upper and lower stiffeners 80 and 81 together. While the connector 10 is described as an actual mounting connector in this embodiment, it may alternatively be used as an inspection connector.

Figure 2:
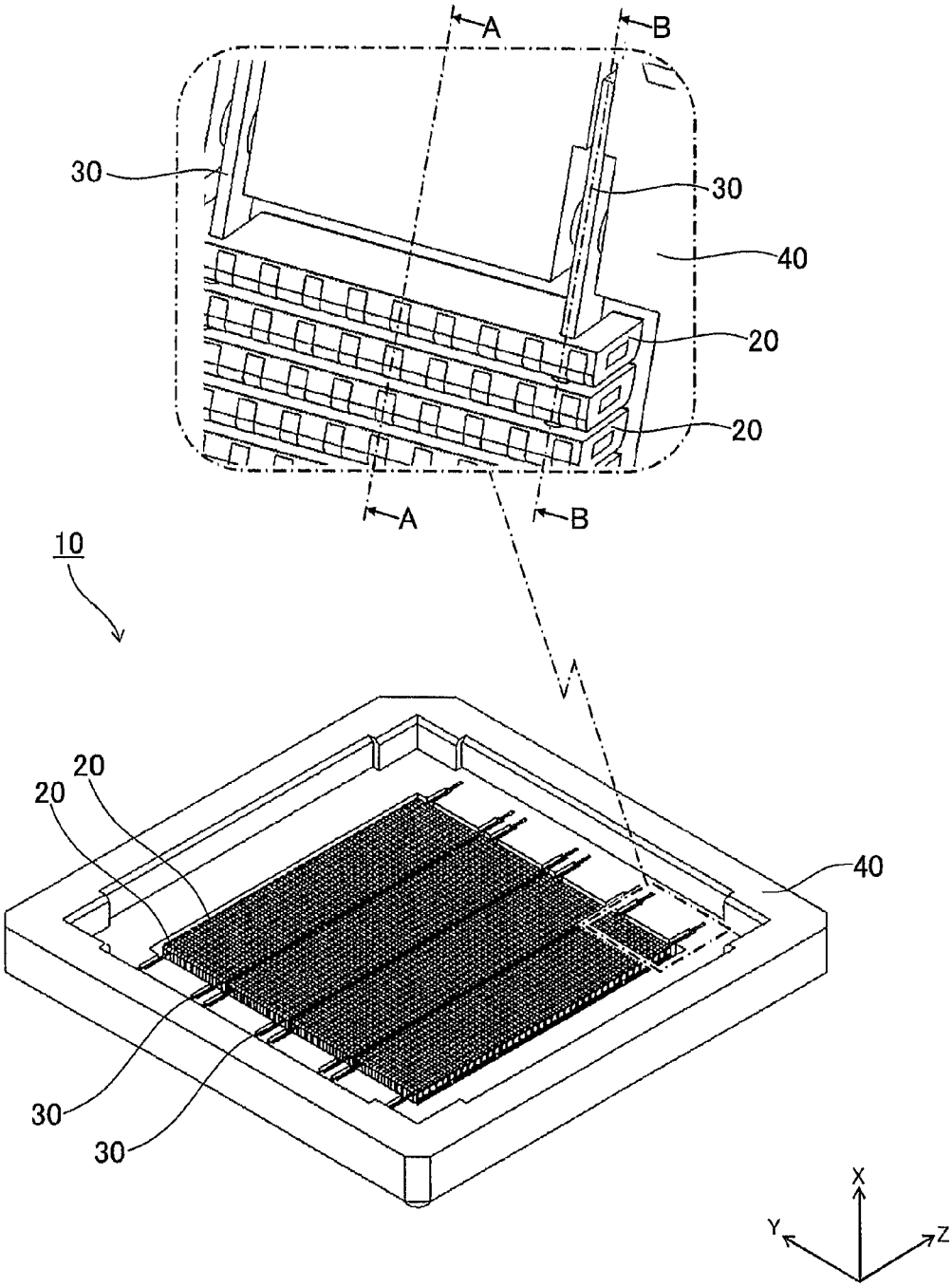
FIG. 2 is a perspective view showing the connector and an enlarged partial view thereof.
Figure 3:
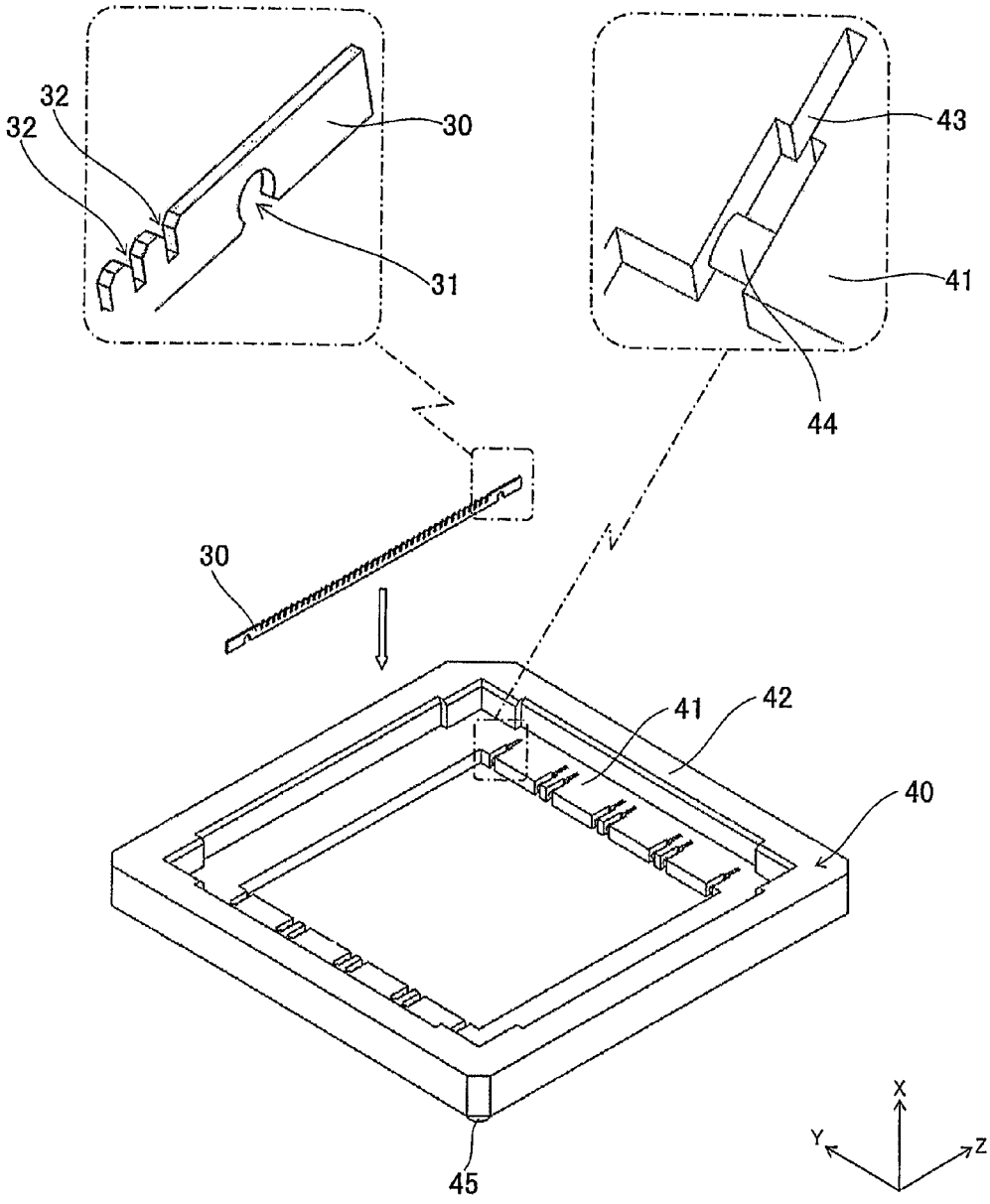
FIG. 3 is a perspective view showing a beam and a frame and enlarged partial views thereof.
Figure 4:
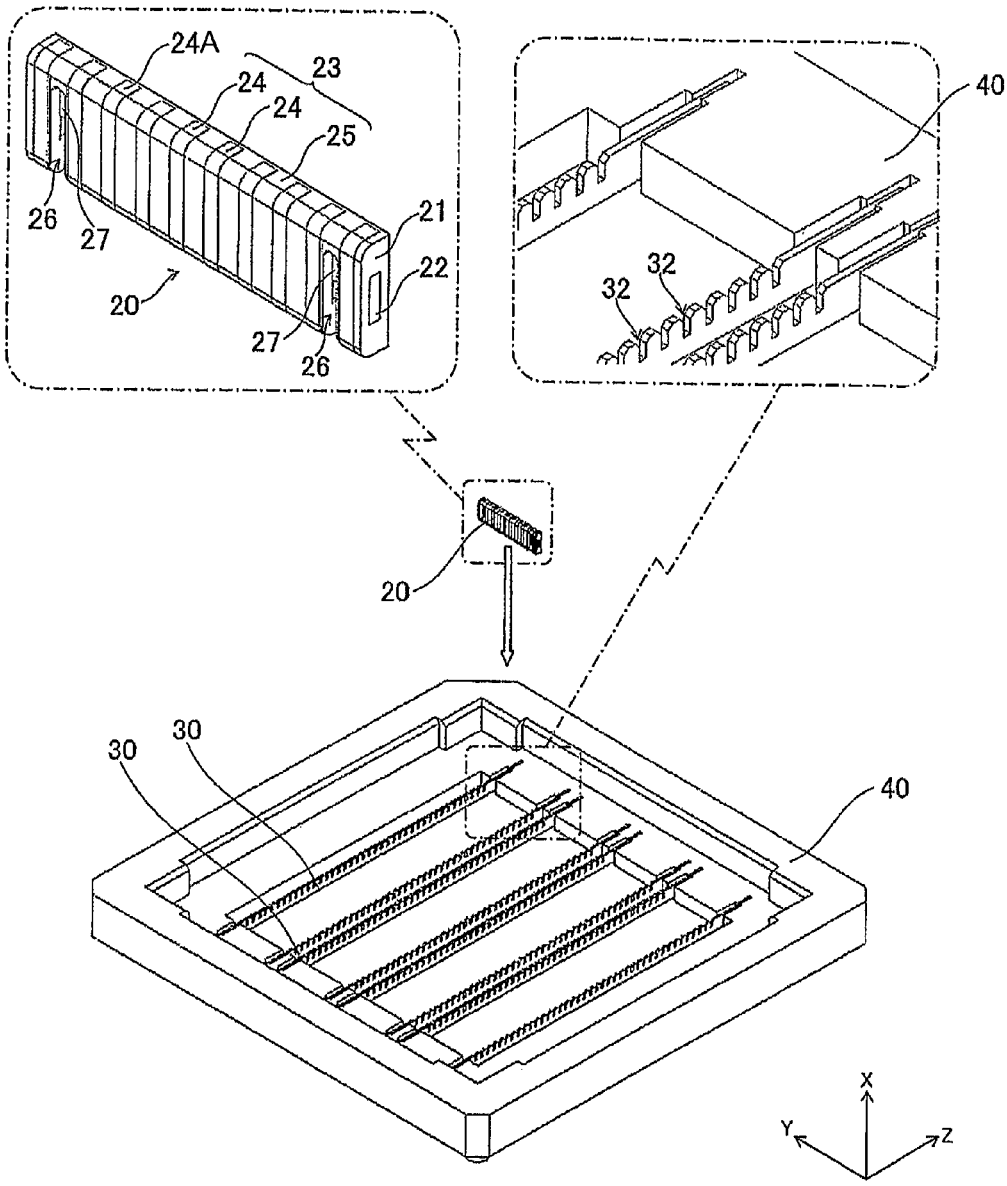
FIG. 4 is a perspective view showing the beams, the frame, and a connecting member and enlarged partial views thereof.

As shown in FIGS. 2 to 4, the connector 10 comprises a plurality of connecting members 20, a plurality of beams 30 holding the connecting members 20, and a frame 40 supporting the beams 30.

As shown in FIG. 2, the connecting members 20, each having a longitudinal direction extending in the second direction Y, are arranged in the third direction Z. Each connecting member 20 lies over the two beams 30 arranged in the second direction Y and is engaged with and held by those two beams 30. While the number of the beams 30 that engage and hold the connecting member 20 may be any number such as one or three, if the connecting member 20 is engaged with and held by the two or more beams 30, the holding state of the connecting member 20 is more stable compared to the case where the connecting member 20 is engaged with and held by the single beam 30.

As shown in FIG. 2, four rows, each comprising the connecting members 20 arranged in the third direction Z, are arranged in the second direction Y. The connecting members 20 are adjacently arranged in the second direction Y with no gap (or with almost no gap) therebetween in the second direction Y. The number of the rows of the connecting members 20 may be any number such as one, two, or three.

Figure 5:
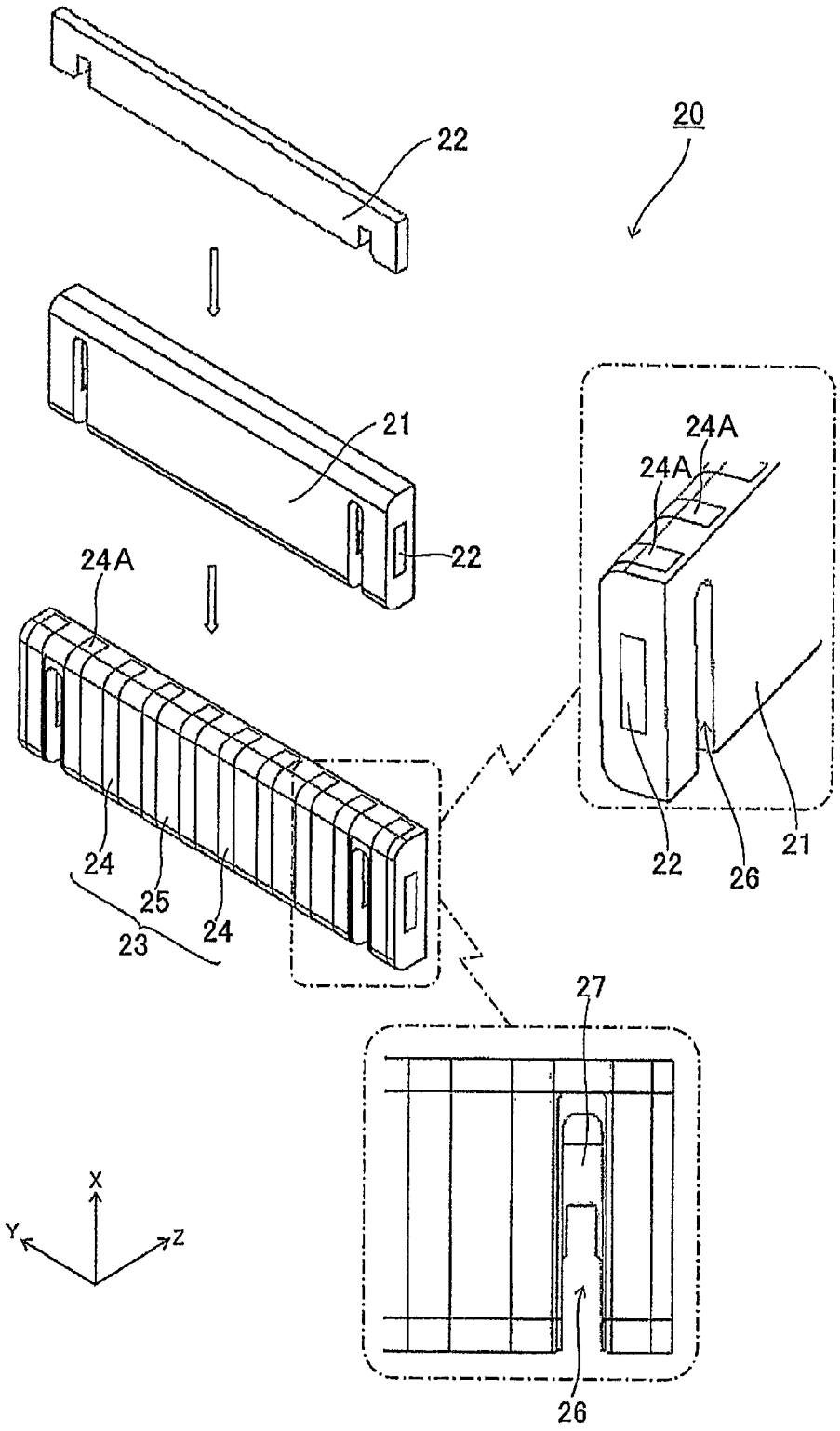
FIG. 5 is an explanatory diagram of the connecting member.

As shown in FIGS. 4 and 5, each connecting member 20 comprises an insulating elastic member 21, a carrier 22 disposed through the inside of the elastic member 21 along the second direction Y, and a film 23 bonded to a surface of the elastic member 21.

The elastic member 21 is made of a synthetic rubber or the like while the carrier 22 is made of a material, such as an insulating resin or a metal, having a higher strength than the elastic member 21.

Figure 6:
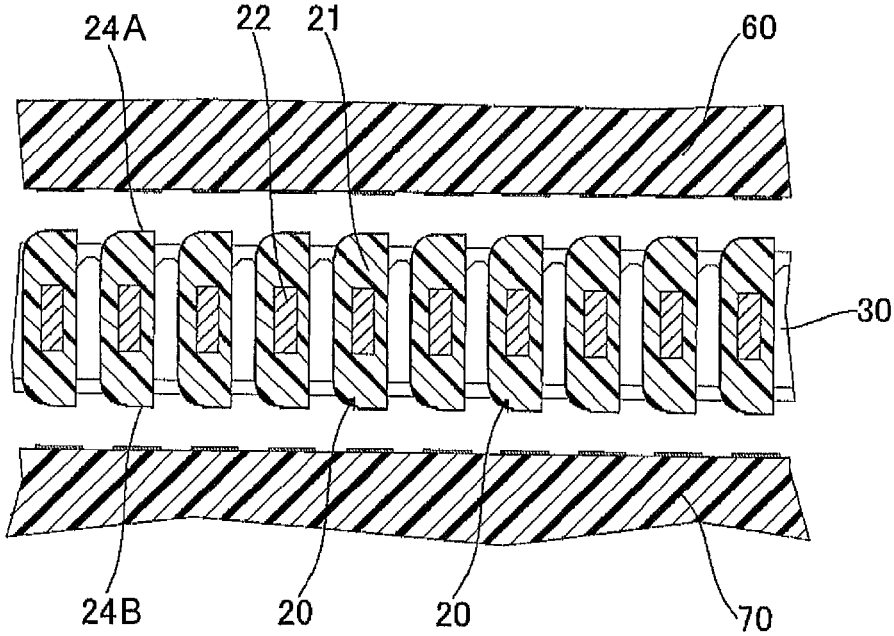
FIG. 6 is a cross-sectional view taken along line A-A of FIG. 2, showing the connector and connection objects.
Figure 6:
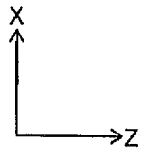

As shown in FIGS. 4 and 5, the film 23 is formed with conductive portions 24 and insulating portions 25 which are alternately arranged in the second direction Y. Instead of bonding the film 23 to the surface of the elastic member 21, the conductive portions 24 may be formed directly on the surface of the elastic member 21 by sputtering or the like. As shown in FIGS. 4 to 6, a part, which faces the first connection object 60 in the first direction X, of each of the conductive portions 24 of the connecting members 20 serves as a first contact portion 24A which is brought into contact with the first connection object 60, while, a part, which faces the second connection object 70 in the first direction X, of each of the conductive portions 24 of the connecting members 20 serves as a second contact portion 24B which is brought into contact with the second connection object 70.

Figure 7:
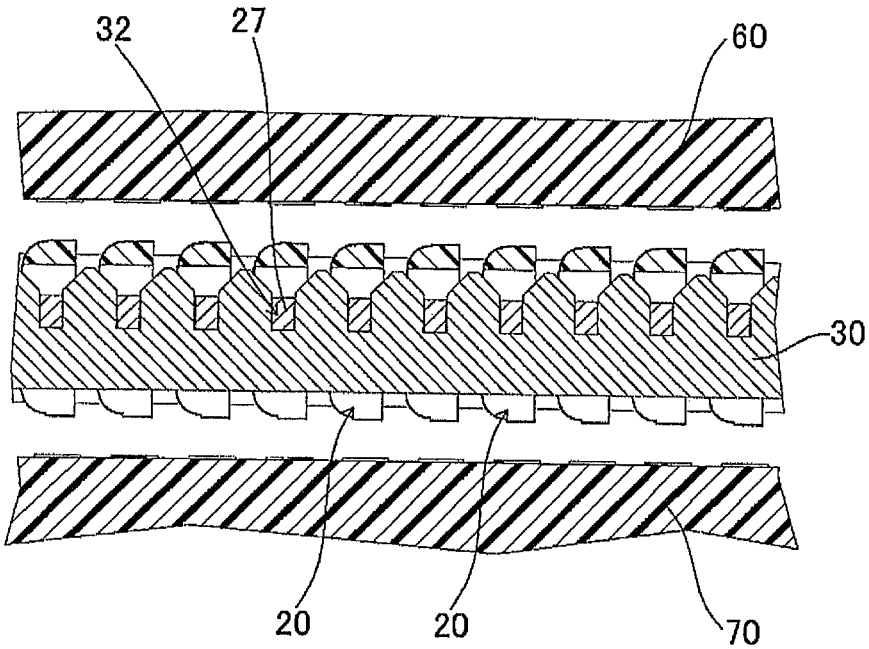
FIG. 7 is a cross-sectional view taken along line B-B of FIG. 2, showing the connector and the connection objects.
Figure 7:
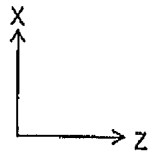

As shown in FIGS. 4 and 5, each connecting member 20 is formed, near both ends thereof in the longitudinal direction, with cutout-like beam receiving portions 26 each crossing the beam 30. Each beam receiving portion 26 has a shape which is recessed in the first direction X from the second connection object 70 side of the connecting member 20 toward another side of the connecting member 20. Each beam 30 is inserted in the first direction X into the beam receiving portions 26 of the connecting members 20 so that, as shown in FIG. 7, each of engaging portions 32 of the beam 30 is aligned in the first direction X with a corresponding one of beam engaging portions 27 of the connecting members 20. Consequently, when the connector 10 is sandwiched between the connection objects 60 and 70, the beams 30 can be disposed at positions which do not preclude elastic deformation of the connecting members 20 or contact between the connecting members 20 and the connection objects 60 and 70. Further, the connecting members 20 are positioned in the second and third directions Y and Z.

As shown in FIG. 5, in each connecting member 20, the carrier 22 is partially exposed to the outside at the bottom of the beam receiving portions 26. These exposed portions of the carrier 22 each serve as the beam engaging portion 27 which is fitted into the engaging portion 32 of the beam 30.

As shown in FIGS. 2 to 4, the beams 30, each having a longitudinal direction extending in the third direction Z, are arranged in the second direction Y so that each beam 30 crosses the connecting members 20 crosswise.

As shown in FIG. 3, each beam 30 has fitting cutout portions 31 near both ends thereof in the longitudinal direction and is fixed to the frame 40 by fitting these fitting cutout portions 31 to fitting shaft portions 44 of the frame 40, respectively. A specific method of fixing the beams 30 to the frame 40 is not limited to the above-mentioned fitting fixation. For example, the beams 30 and the frame 40 made of different materials may be integrally fixed together by insert molding or the beams 30 and the frame 40 made of the same material may be integrally molded together.

As shown in FIGS. 3 and 4, each beam 30 is formed with the cutout-like engaging portions 32 which are arranged along the third direction Z to form the teeth of the comb-like structure. Each engaging portion 32 has a shape which is recessed in the first direction X from the first connection object 60 side of the beam 30 toward the second connection object 70 side thereof. As shown in FIG. 7, the beam engaging portions 27 are respectively inserted in the first direction X into the engaging portions 32. Consequently, the connecting members 20 are attached to the beams 30 and positioned in the second and third directions Y and Z. In order to strengthen the joining relationship between the connecting members 20 and the beams 30, an adhesive may be applied to contact portions between the engaging portions 32 and the beam engaging portions 27.

The frame 40 is made of an insulating resin and has a frame shape. As shown in FIG. 3, the frame 40 comprises a frame bottom plate portion 41 formed with a rectangular hole at its center and a frame side wall portion 42 which is integral with the frame bottom plate portion 41 and which is formed upright along four sides of the frame bottom plate portion 41 and serves as a positioning guide for the first connection object 60.

As shown in FIG. 3, the frame bottom plate portion 41 is formed with positioning grooves 43 that receive both ends of the beams 30 for positioning the beams 30 in the second direction Y and with the fitting shaft portions 44 to which the fitting cutout portions 31 of the beams 30 are respectively fitted. The frame bottom plate portion 41 has a lower surface formed with positioning pins 45 for positioning to the second connection object 70.

In this embodiment described above, since the beams 30 having the engaging portions 32 that engage with the connecting members 20 are disposed so as to perpendicularly cross the connecting members 20, it is possible to support the connecting members 20 at portions other than both ends of the connecting members 20, i.e. at portions inside both ends in the longitudinal direction of the connecting members 20. Therefore, when the connector 10 is sandwiched between the connection objects 60 and 70, it is possible to suppress unwanted deformation, such as distortion or arc-shaped bending in the third direction Z, of the connecting members 20 due to forces applied from the connection objects 60 and 70 and thus to suppress offset in position of the conductive portions 24 (particularly the first contact portions 24A and the second contact portions 24B) due to such unwanted deformation of the connecting members 20. Consequently, it is possible to improve contact reliability of the connector 10.

Figure 15:
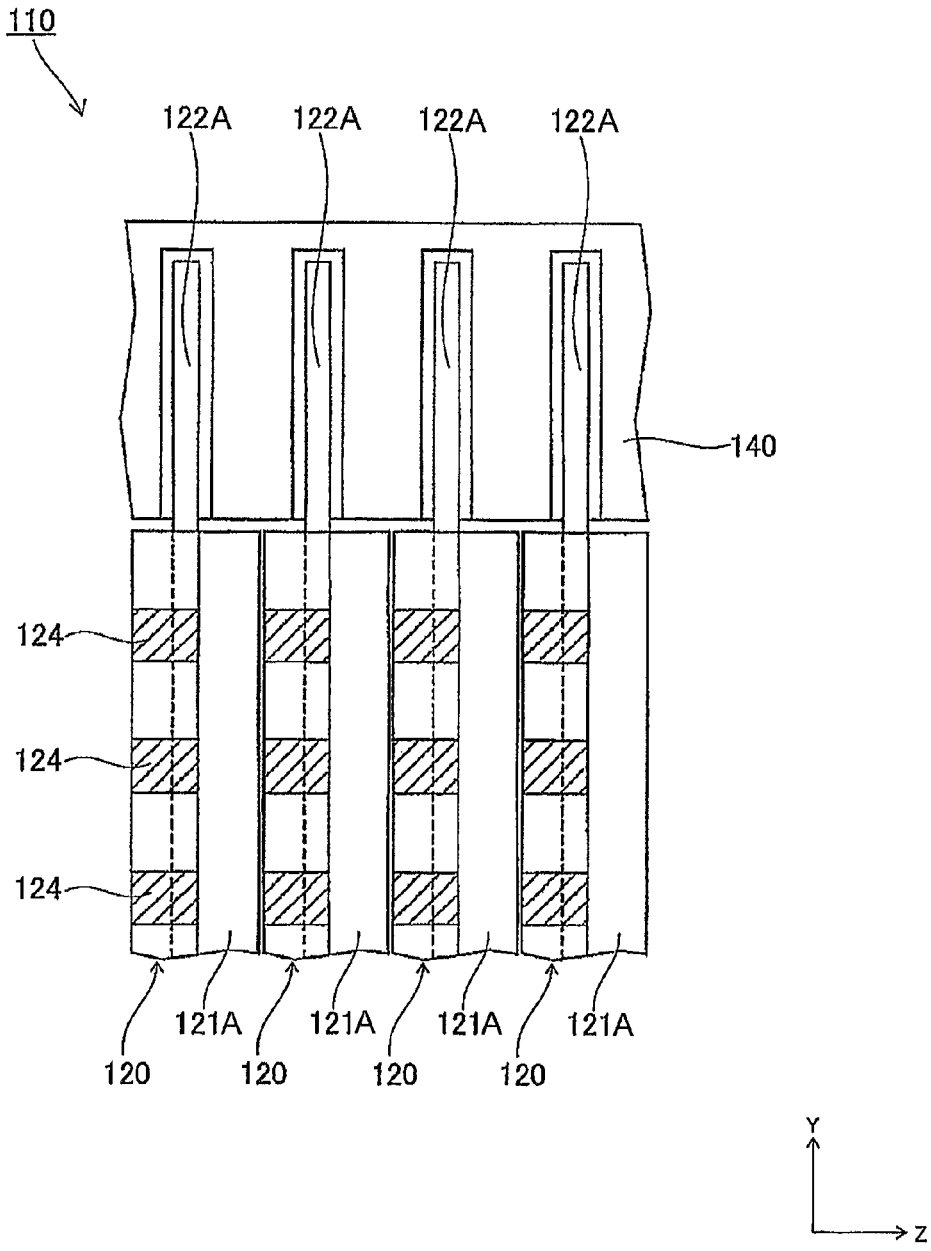
FIG. 15 is a plan view showing a prior art connecting device.
Figure 16:
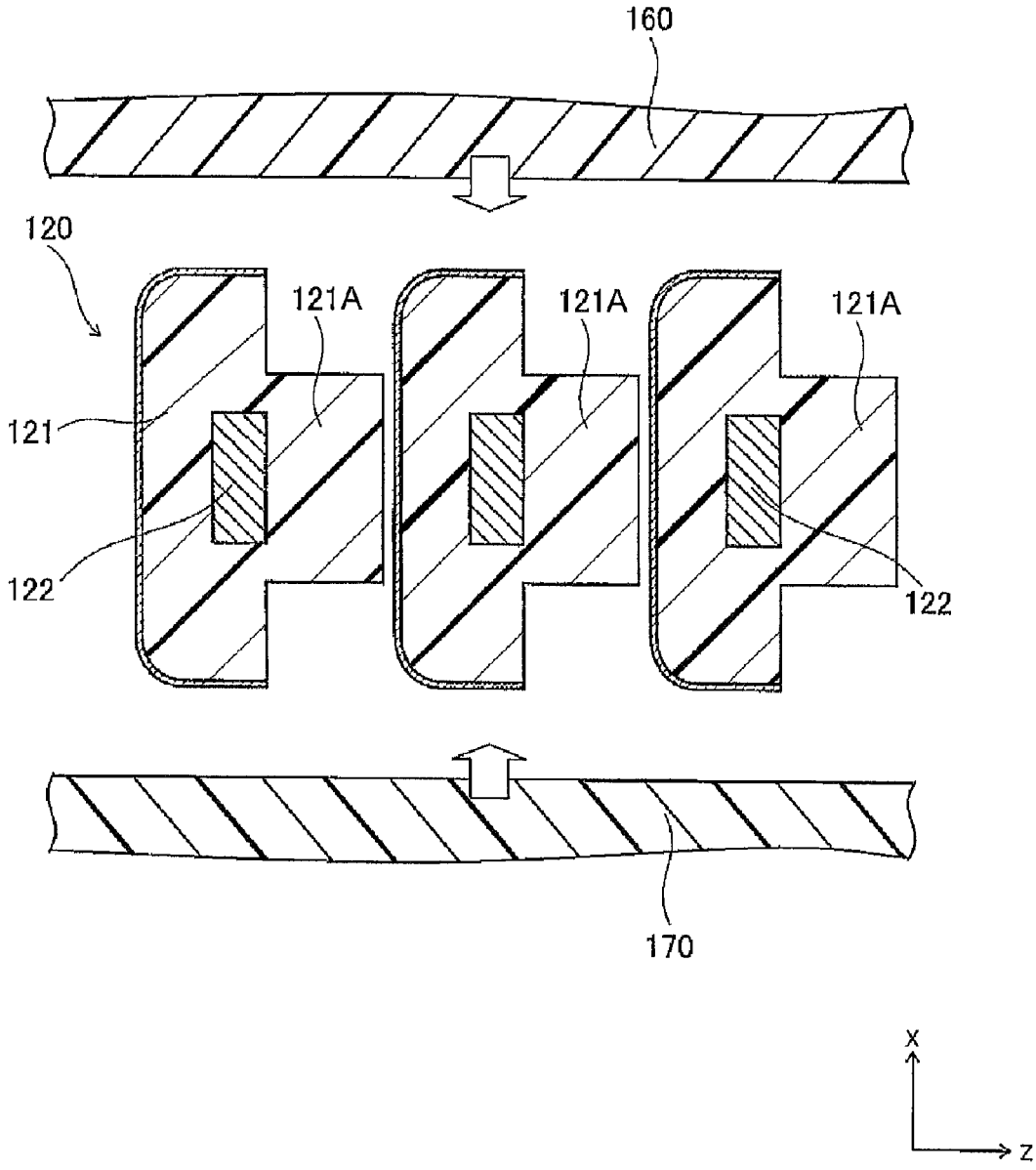
FIG. 16 is a cross-sectional view showing the prior art connecting device and connection objects.

Further, since it is possible to keep constant the distance between the conductive portions 24 of the connecting members 20 adjacent to each other in the third direction Z without providing the inter-pitch portion 121A for keeping constant the distance between the conductors 124 as in the prior art connecting device 110 shown in FIGS. 15 and 16. Consequently, it is possible to achieve pitch narrowing of the conductive portions 24 in the third direction Z.

Further, in this embodiment, by employing the structure in which the portions other than both ends of the connecting members 20 are supported by the beams 30, when the connecting members 20 are arranged in the second direction Y as shown in FIG. 2, the connecting members 20 can be adjacently arranged with no gap (or with almost no gap) therebetween in the second direction Y.

On the other hand, with the structure in which both ends in the longitudinal direction of the connecting members 120 are supported by the frame 140 as in the prior art connecting device 110 shown in FIGS. 15 and 16, when the connecting members 120 are arranged in the second direction Y, the connecting members 120 cannot be adjacently arranged with no gap therebetween in the second direction Y.

Further, in this embodiment, each connecting member 20 can be attached to the beam 30 only by moving the connecting member 20 in the first direction X to approach and engage with the beam 30. Therefore, the attachment of the connecting members 20 can be achieved easily and simply.

Further, since the beams 30 are each fixedly mounted over the frame-shaped frame 40, the beams 30 serve as reinforcing beams so that the strength of the frame 40 can be improved.

Figure 8:
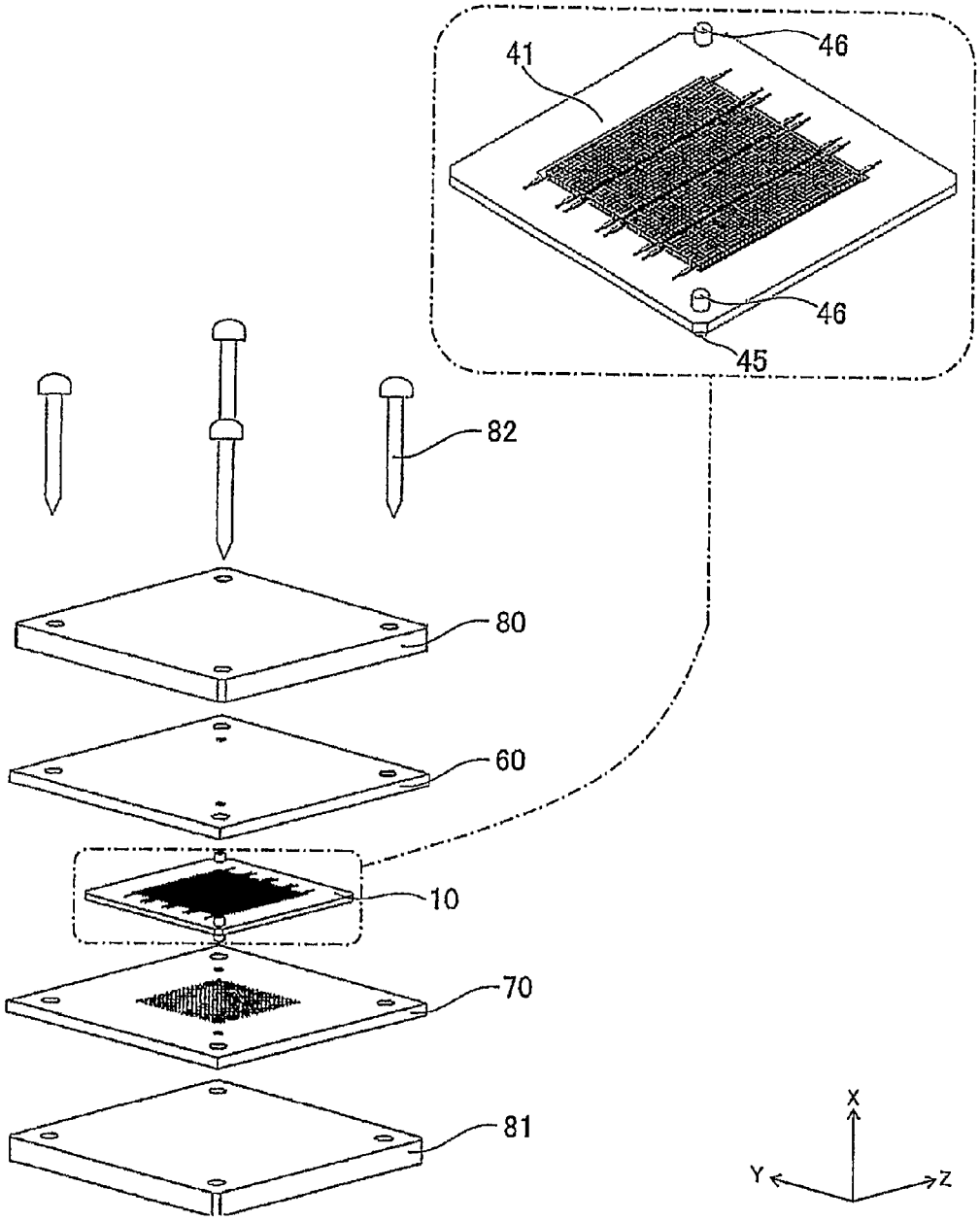
FIG. 8 is a perspective view showing the manner of using a connector according to a second embodiment of this invention.

Next, a second embodiment of this invention will be described with reference to FIG. 8. Only a difference from the first embodiment will be described hereinbelow.

In the first embodiment shown in FIG. 1, the first connection object 60 is formed as the IC package. On the other hand, in the second embodiment shown in FIG. 8, a first connection object 60 is formed as an upper board. Following this, in the second embodiment shown in FIG. 8, a connector 10 does not have the above-mentioned frame side wall portion 42 which serves as the positioning guide for the IC package, but has, instead, positioning pins 46 for the upper board which are formed on an upper surface of a frame bottom plate portion 41.

Next, a third embodiment of this invention will be described with reference to FIGS. 9 and 10. Only a difference from the first embodiment will be described hereinbelow.

Figure 9:
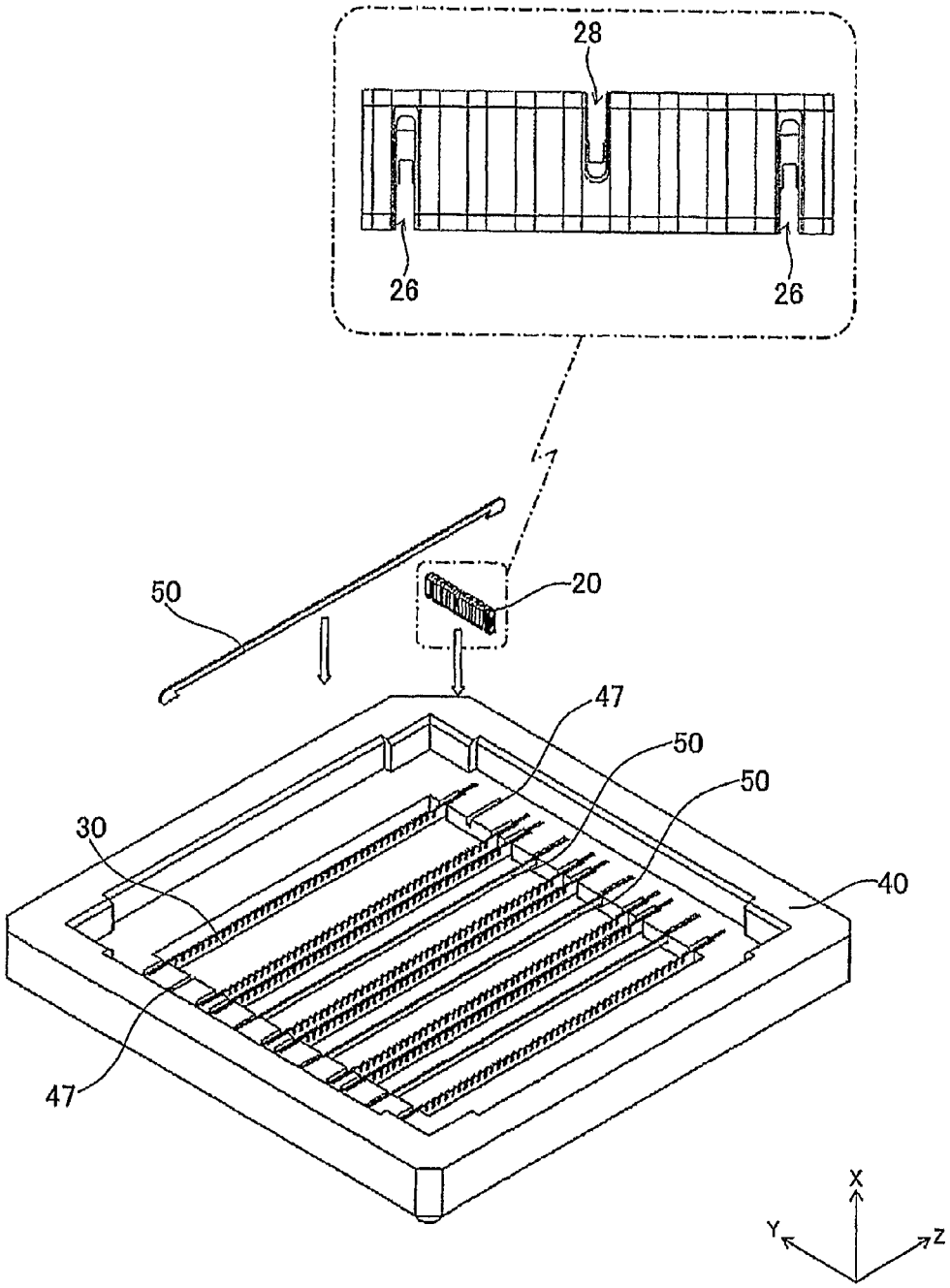
FIG. 9 is a perspective view showing a frame, beams, pressing members, and a connecting member of a connector according to a third embodiment of this invention and an explanatory diagram showing the connecting member on an enlarged scale.
Figure 10:
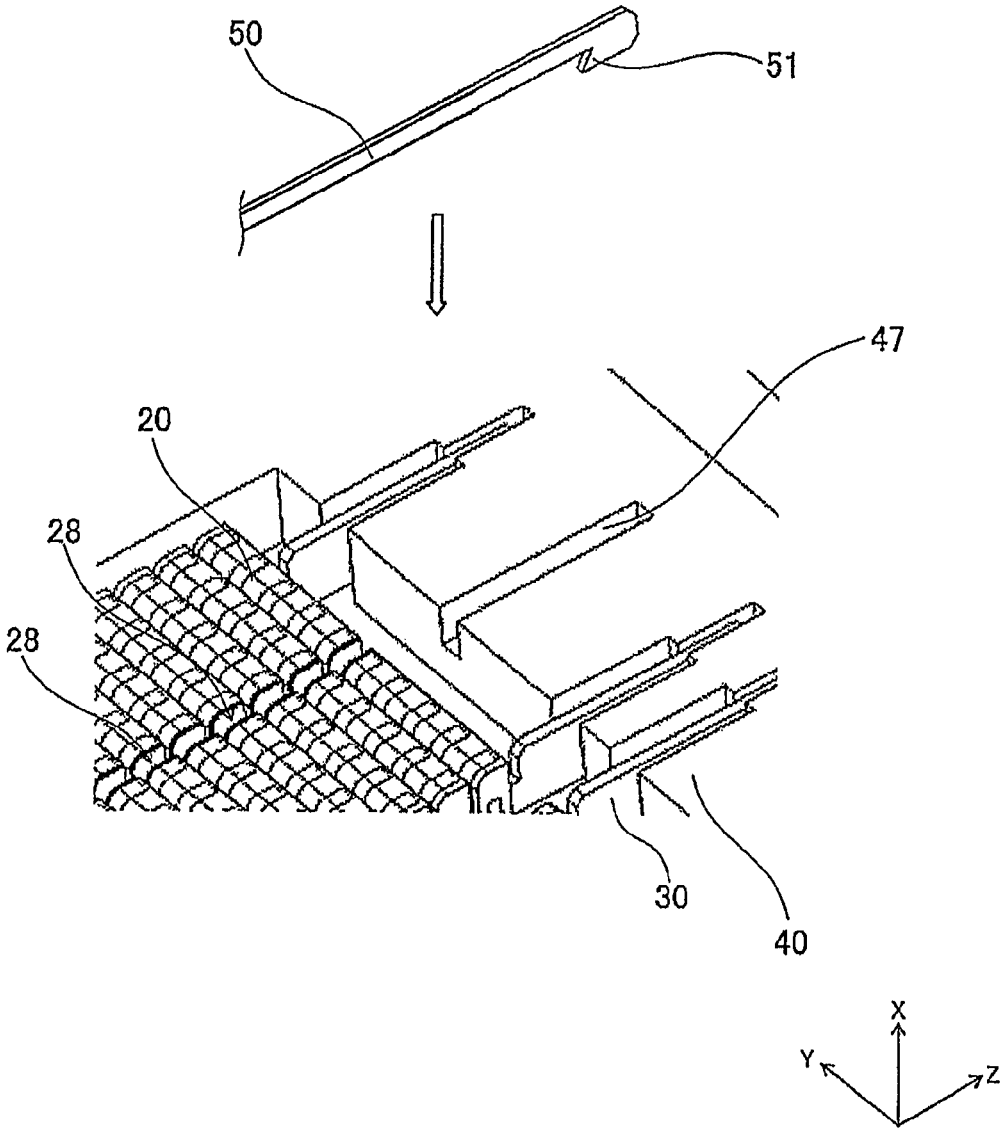
FIG. 10 is a perspective view showing part of the connector shown in FIG. 9.

In the third embodiment, as shown in FIGS. 9 and 10, pressing members 50 are further provided for preventing connecting members 20 from coming off. As shown in FIG. 10, each pressing member 50 is disposed with its longitudinal direction extending in the third direction Z so as to perpendicularly cross the connecting members 20 and is arranged on the side opposite to beams 30 in the first direction X with respect to the connecting members 20. As shown in FIG. 10, both ends in the longitudinal direction of the pressing member 50 are respectively inserted in the first direction X into pressing member grooves 47 formed on a frame 40 so that frame engaging portions 51 formed at both ends in the longitudinal direction of the pressing member 50 engage with the frame 40. Consequently, the pressing member 50 is detachably attached to the frame 40.

In the third embodiment, as shown in FIGS. 9 and 10, each connecting member 20 has a cutout-like pressing member receiving portion 28 at a middle portion thereof in its longitudinal direction which crosses the pressing member 50. The pressing member receiving portion 28 has a shape which is recessed in the first direction X from the first connection object 60 side of the connecting member 20 toward the second connection object 70 side thereof. The pressing member 50 is inserted in the first direction X into the pressing member receiving portions 28 of the connecting members 20 so that the pressing member 50 is disposed at middle portions in the first direction X of the connecting members 20. Consequently, when a connector 10 is sandwiched between the connection objects 60 and 70, the pressing members 50 can be disposed at positions which do not preclude elastic deformation of the connecting members 20 or contact between the connecting members 20 and the connection objects 60 and 70. Further, the connecting members 20 are positioned in the second direction Y by the pressing members 50 so that it is possible to further suppress unwanted deformation, such as distortion or arc-shaped bending in the third direction Z, of the connecting members 20.

Figure 11:
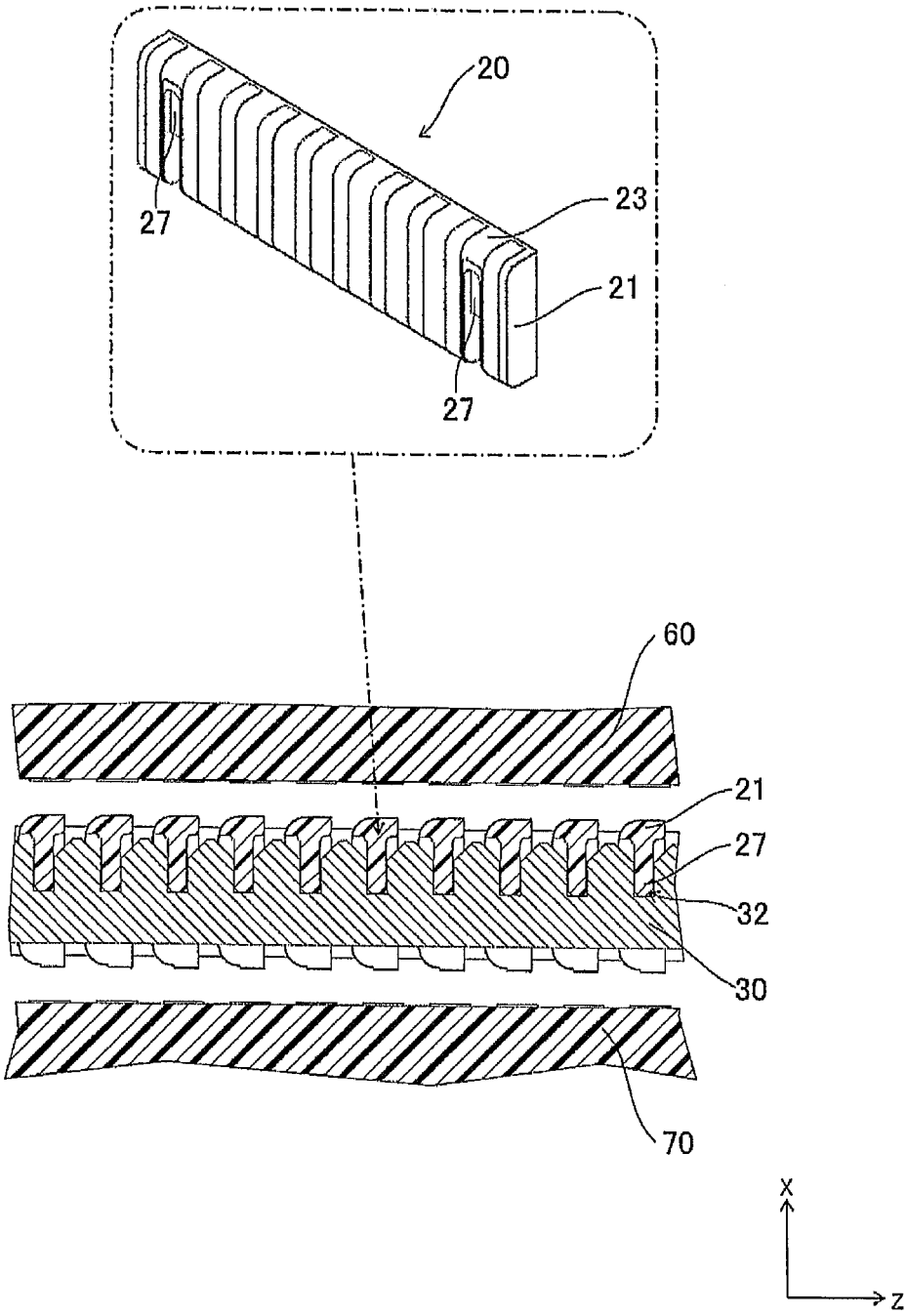
FIG. 11 is a cross-sectional view corresponding to FIG. 7, showing a connector according to a fourth embodiment of this invention and a perspective view showing a connecting member.

Next, a fourth embodiment of this invention will be described with reference to FIG. 11. Only a difference from the first embodiment will be described hereinbelow.

In the first embodiment, as shown in FIG. 5, each connecting member 20 comprises the elastic member 21, the carrier 22, and the film 23. On the other hand, in the fourth embodiment shown in FIG. 11, each connecting member 20 comprises an insulating elastic member 21 and a film 23, i.e. the carrier 22 is not provided. Following this, in the fourth embodiment, beam engaging portions 27 of each connecting member 20 which are fitted into engaging portions 32 of beams 30 are integrally formed with the elastic member 21.

Next, a fifth embodiment of this invention will be described with reference to FIG. 12. Only a difference from the first embodiment will be described hereinbelow.

Figure 12:
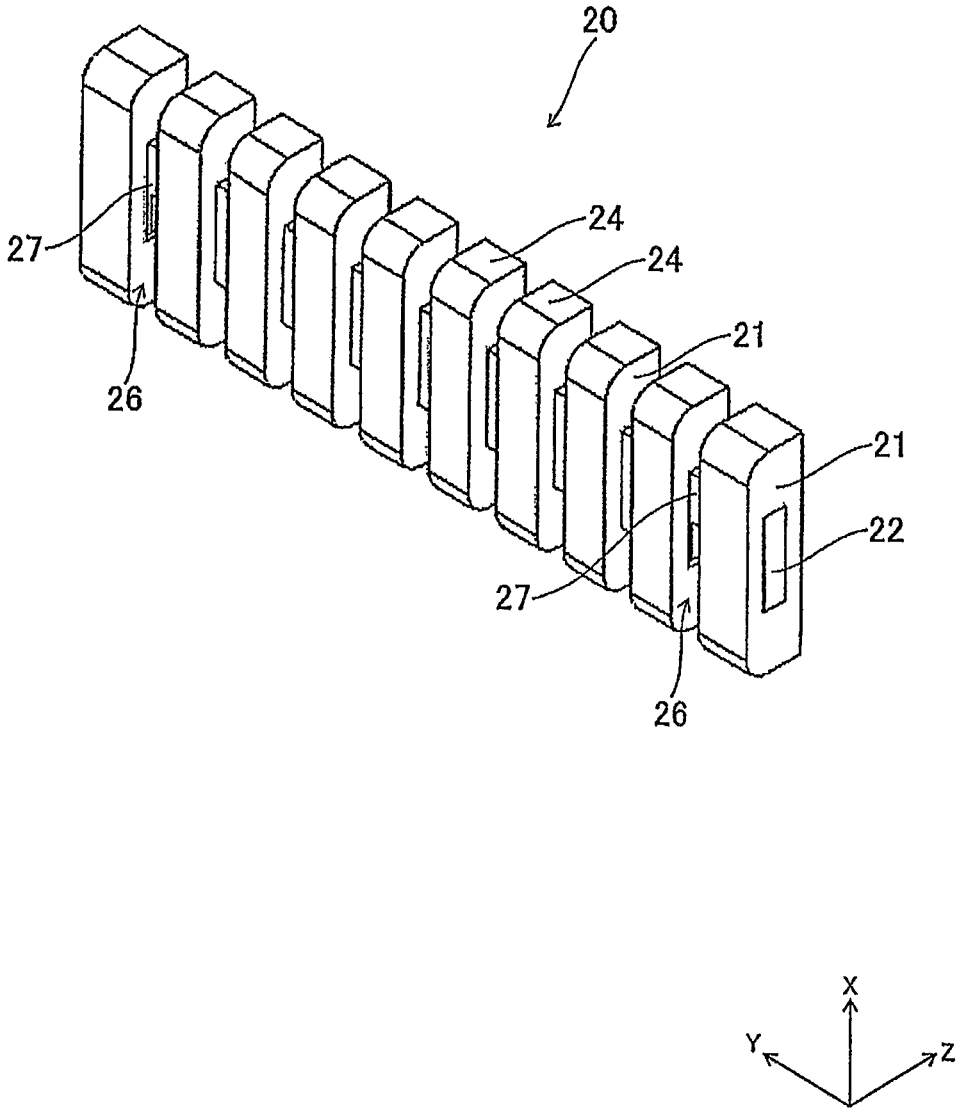
FIG. 12 is a perspective view showing a connecting member which is incorporated into a connector according to a fifth embodiment of this invention.

In the fifth embodiment, as shown in FIG. 12, a plurality of insulating elastic members 21 are arranged on a carrier 22 in each connecting member 20 so as to be spaced apart from each other at a predetermined interval in the second direction Y. A conductive portion 24 is formed on a surface of each elastic member 21. The conductive portion 24 is formed on the surface of each elastic member 21 by bonding a conductive film to the surface thereof or by sputtering on the surface thereof. Alternatively, the elastic member 21 may be a conductive elastic member mixed with conductive particles. In the fifth embodiment, two of spaces formed between the elastic members 21 adjacent to each other in the second direction Y serve as beam receiving portions 26 each for receiving part of a beam 30.

Figure 13:
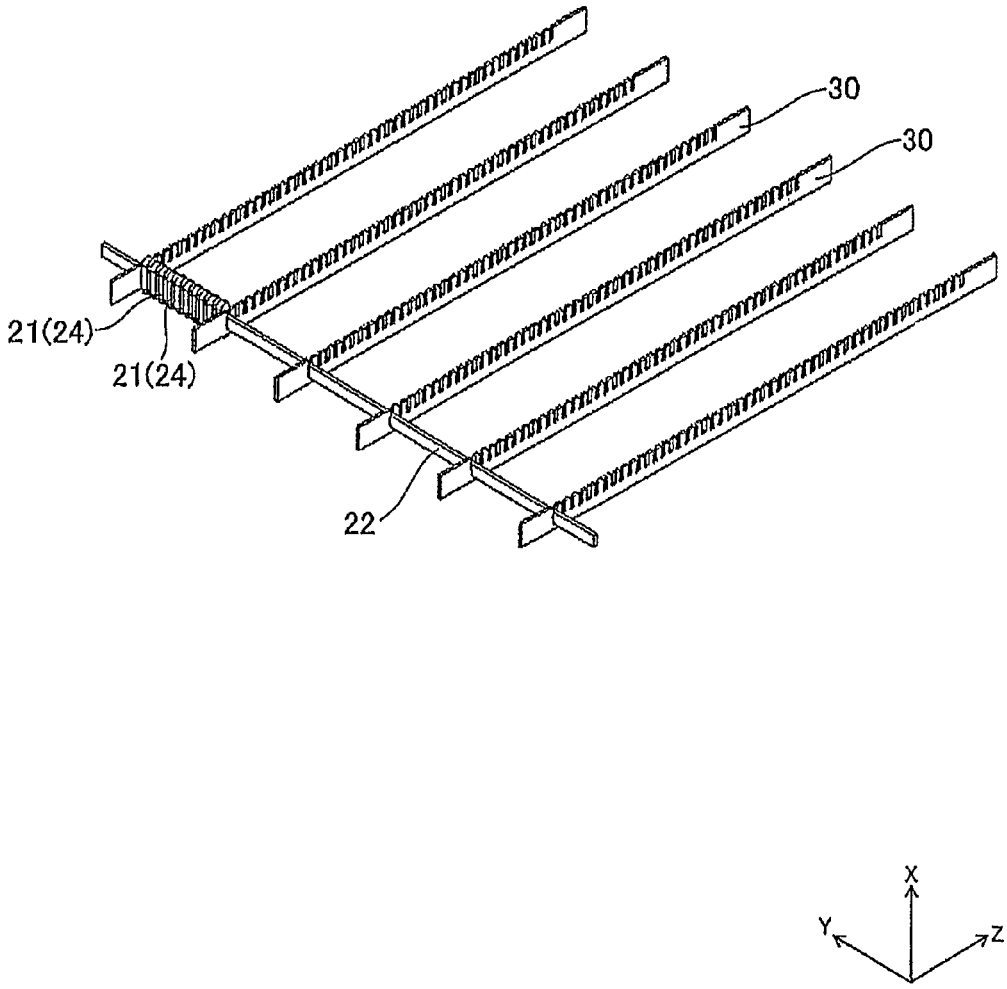
FIG. 13 is a perspective view showing a state during assembly of connecting members and beams of a connector according to a sixth embodiment of this invention.
Figure 14:
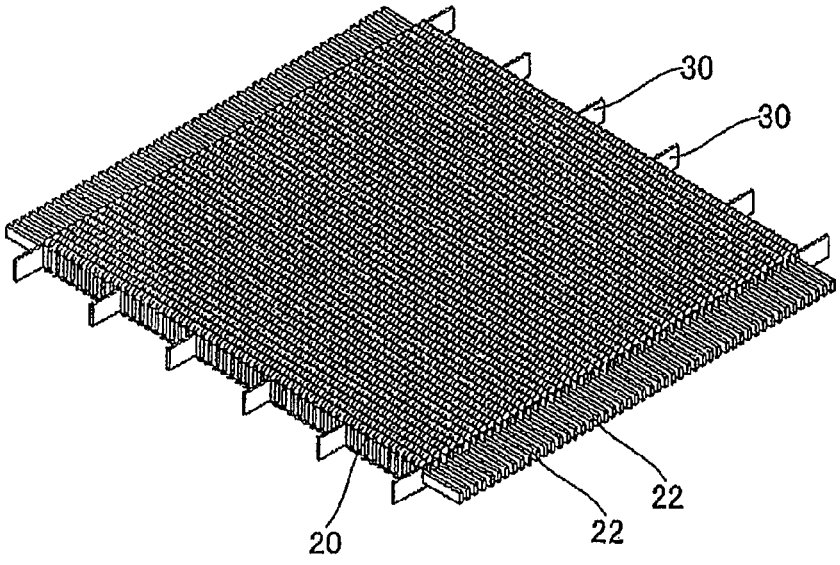
FIG. 14 is a perspective view showing a state after the assembly of the connecting members and the beams of the connector according to the sixth embodiment of this invention.
Figure 14:
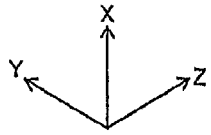

Next, a sixth embodiment of this invention will be described with reference to FIGS. 13 and 14. Only a difference from the fifth embodiment will be described hereinbelow. While only one group of elastic members 21 is illustrated in FIG. 13, five groups of elastic members 21 are actually provided and illustration of the other four groups is omitted.

In the sixth embodiment, the carriers 22 separately arranged in the second direction Y in the fifth embodiment are formed by a single carrier 22 extending in the second direction Y so that the five groups of the elastic members 21 arranged between beams 30 are integrated together by this single carrier 22. Consequently, in the sixth embodiment, the number of the beams 30 required for satisfactorily supporting connecting members 20 can be reduced, resulting in a reduction in workload required for assembly of a connector 10.

While the six embodiments of the connectors of this invention have been described above, the techniques of the above-mentioned first to sixth embodiments may be properly combined and carried out.

What is claimed is:

1. A connector which is adapted to be interposed between a first connection object and a second connection object for establishing electrical connection therebetween, comprising:

a plurality of connecting members each having a plurality of elastically deformable conductive portions formed at a predetermined interval along a longitudinal direction thereof; a beam holding the connecting members; and a support portion supporting the beam, wherein the connecting members, each having its longitudinal direction extending in a second direction perpendicular to a first direction in which the first and second connection objects are caused to approach each other, are arranged in a third direction perpendicular to the first and second directions, and wherein the beam is disposed with its longitudinal direction extending in the third direction so as to perpendicularly cross the connecting members, the beam having engaging portions, engaging with the connecting members, at positions where the beam crosses the connecting members.

2. The connector according to claim 1, wherein each of the connecting members has a beam receiving portion having a shape in which a portion, crossing the beam, of the connecting member is recessed in the first direction from its second connection object side toward its first connection object side, and wherein the beam is inserted in the first direction into the beam receiving portions of the connecting members and received therein.

3. The connector according to claim 1, wherein each of the engaging portions of the beam has a shape which is recessed in the first direction from the first connection object side of the beam toward the second connection object side thereof, wherein each of the connecting members has beam engaging portions, and wherein the beam engaging portions of the connecting members are inserted in the first direction into the engaging portions of the beam to engage therewith.

4. The connector according to claim 1, further comprising a pressing member attached to the support portion for preventing the connecting members from coming off, wherein the pressing member is disposed with its longitudinal direction extending in the third direction so as to perpendicularly cross the connecting members and is arranged on a side opposite to the beam in the first direction with respect to the connecting members.

5. The connector according to claim 4, wherein each of the connecting members has a pressing member receiving portion having a shape in which a portion, crossing the pressing member, of the connecting member is recessed in the first direction from its first connection object side toward its second connection object side, and wherein the pressing member is inserted in the first direction into the pressing member receiving portions of the connecting members and received therein.

6. The connector according to claim 1, wherein each of the connecting members comprises an elastic member and a film attached to a surface of the elastic member, and wherein the film is formed with the conductive portions and insulating portions which are alternately arranged in the second direction.

7. The connector according to claim 6, wherein each of the connecting members further comprises a carrier disposed through the inside of the elastic member along the second direction.

8. The connector according to claim 7, wherein the elastic member comprises a plurality of elastic members which are arranged on the carrier so as to be spaced apart from each other at a predetermined interval in the second direction, wherein at least one of spaces formed between the elastic members adjacent to each other in the second direction serves as a beam receiving portion having a shape which is recessed in the first direction from the second connection object side of the connecting member toward the first connection object side thereof, and wherein the beam is inserted in the first direction into the beam receiving portions of the connecting members and received therein.

9. The connector according to claim 1, wherein the beam comprises a plurality of beams arranged in the second direction, and wherein each of the connecting members lies over at least two of the beams arranged in the second direction.

10. The connector according to claim 1, wherein the connecting members are arranged in the second direction, and wherein the connecting members arranged in the second direction are adjacent to each other in the second direction.

11. The connector according to claim 1, wherein the beam is formed separately from the support portion and fixed to the support portion.

* * * * *